US006843694B2

(12) United States Patent
Simmons

(10) Patent No.: US 6,843,694 B2
(45) Date of Patent: Jan. 18, 2005

(54) WEARABLE EMERGENCY FLOTATION DEVICE

(75) Inventor: Ivan Simmons, Jupiter, FL (US)

(73) Assignee: Light Bulb, LLC, Jupiter, FL (US)

( * ) Notice: Subject to any disclaimer, the term of this patent is extended or adjusted under 35 U.S.C. 154(b) by 0 days.

(21) Appl. No.: 10/330,880

(22) Filed: Dec. 26, 2002

(65) Prior Publication Data

US 2004/0127118 A1 Jul. 1, 2004

(51) Int. Cl.[7] ..... B63C 9/08
(52) U.S. Cl. ..... 441/89; 441/96
(58) Field of Search ..... 441/88, 89, 90, 441/95, 96, 97, 100

(56) References Cited

U.S. PATENT DOCUMENTS 3,669,311 A * 6/1972 Folden et al. ..... 222/3
4,622,018 A 11/1986 Blanc
4,768,128 A * 8/1988 Jankowiak et al. ..... 361/251
4,925,419 A 5/1990 Susanna
5,030,152 A * 7/1991 Carr et al. ..... 441/89
5,326,297 A * 7/1994 Loughlin ..... 441/89
5,421,760 A 6/1995 Blaga
5,496,136 A * 3/1996 Egan ..... 405/186
5,560,738 A * 10/1996 Noel ..... 405/186
5,685,455 A * 11/1997 Glasa ..... 222/5
5,692,933 A 12/1997 Bradley et al.
5,746,543 A * 5/1998 Leonard ..... 405/186
5,746,633 A 5/1998 Jeffrey
5,813,891 A 9/1998 McNamee

* cited by examiner

*Primary Examiner*—Stephen Avila
(74) *Attorney, Agent, or Firm*—McHale & Slavin, P.A.

(57) ABSTRACT

This invention relates to emergency flotation devices, particularly to a wearable device in the form of a collar; and most particularly to a device suitable for wear by a pet or young child which may be worn during watersports, and which will not deploy until predetermined nominal safety parameters have been exceeded. The present invention provides a personal flotation device, suitable for children, pets or the like, which will activate automatically in response to changes in pressure, e.g. water depth, time of submersion, or a combination thereof. As the device senses the change in pressure or time of prolonged submersion, the internal triggering mechanism punctures a hole permitting the compressed gas reservoir contained therein to be released, thereby inflating the device's inner flotation member.

6 Claims, 5 Drawing Sheets

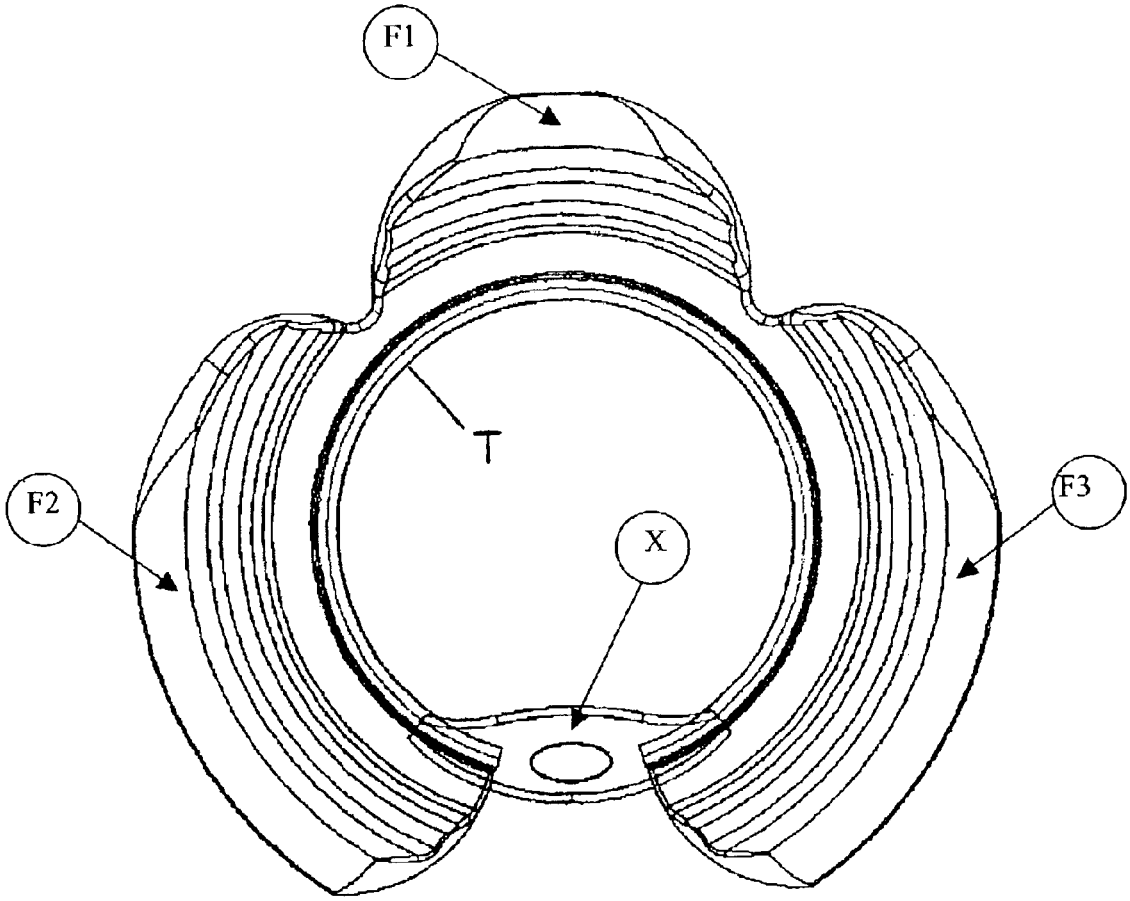
FIGURE I

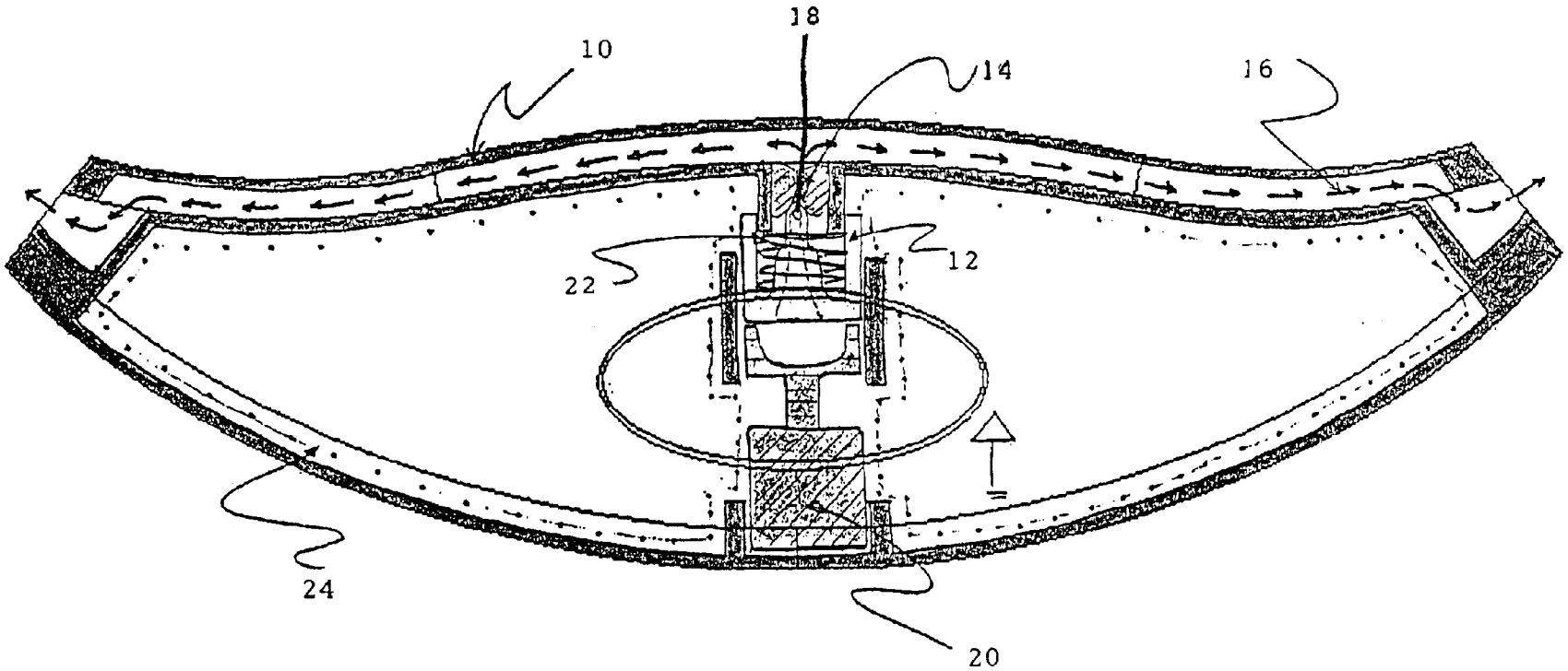
FIGURE II

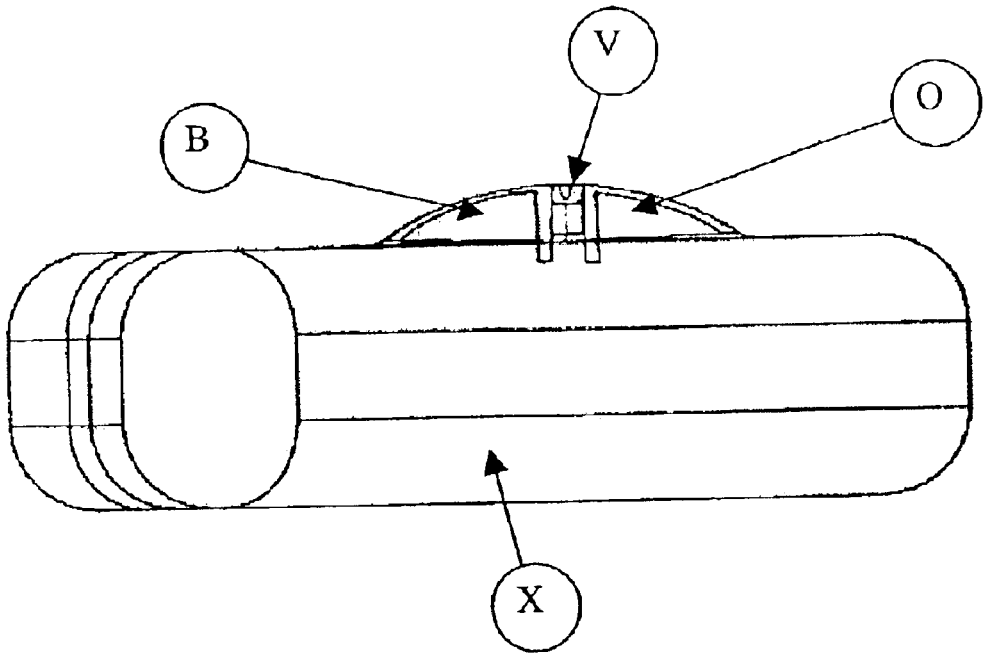
FIGURE III

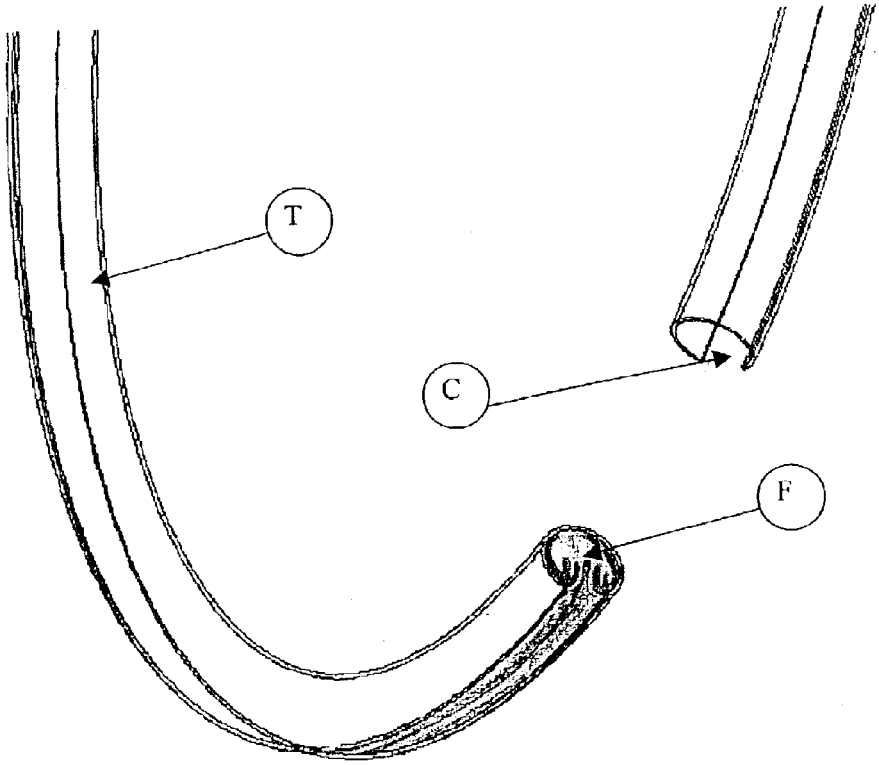
FIGURE IV
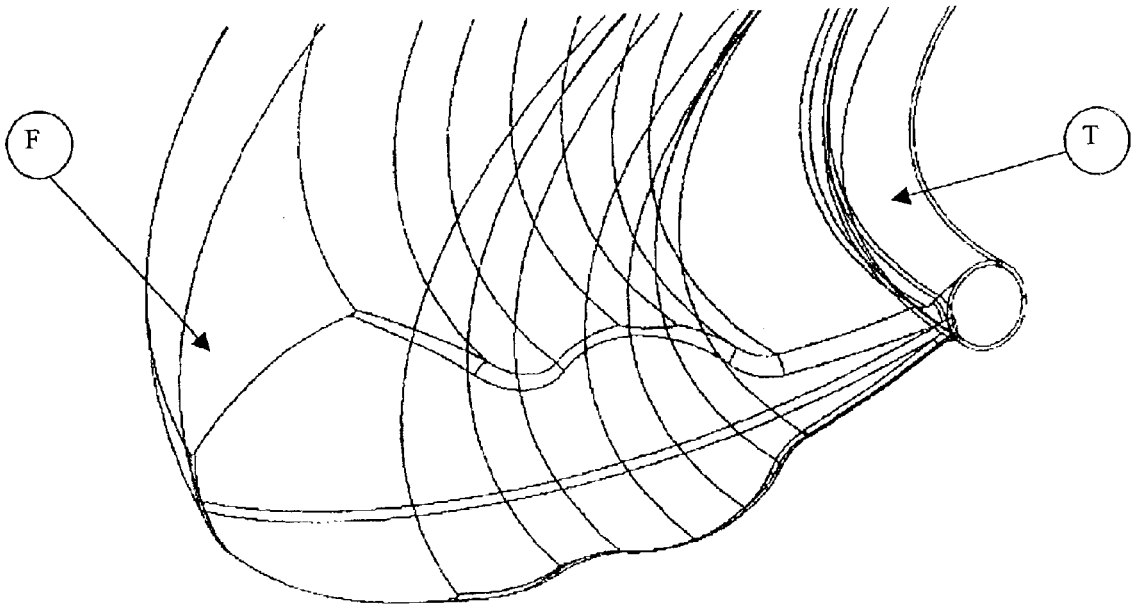
FIGURE V

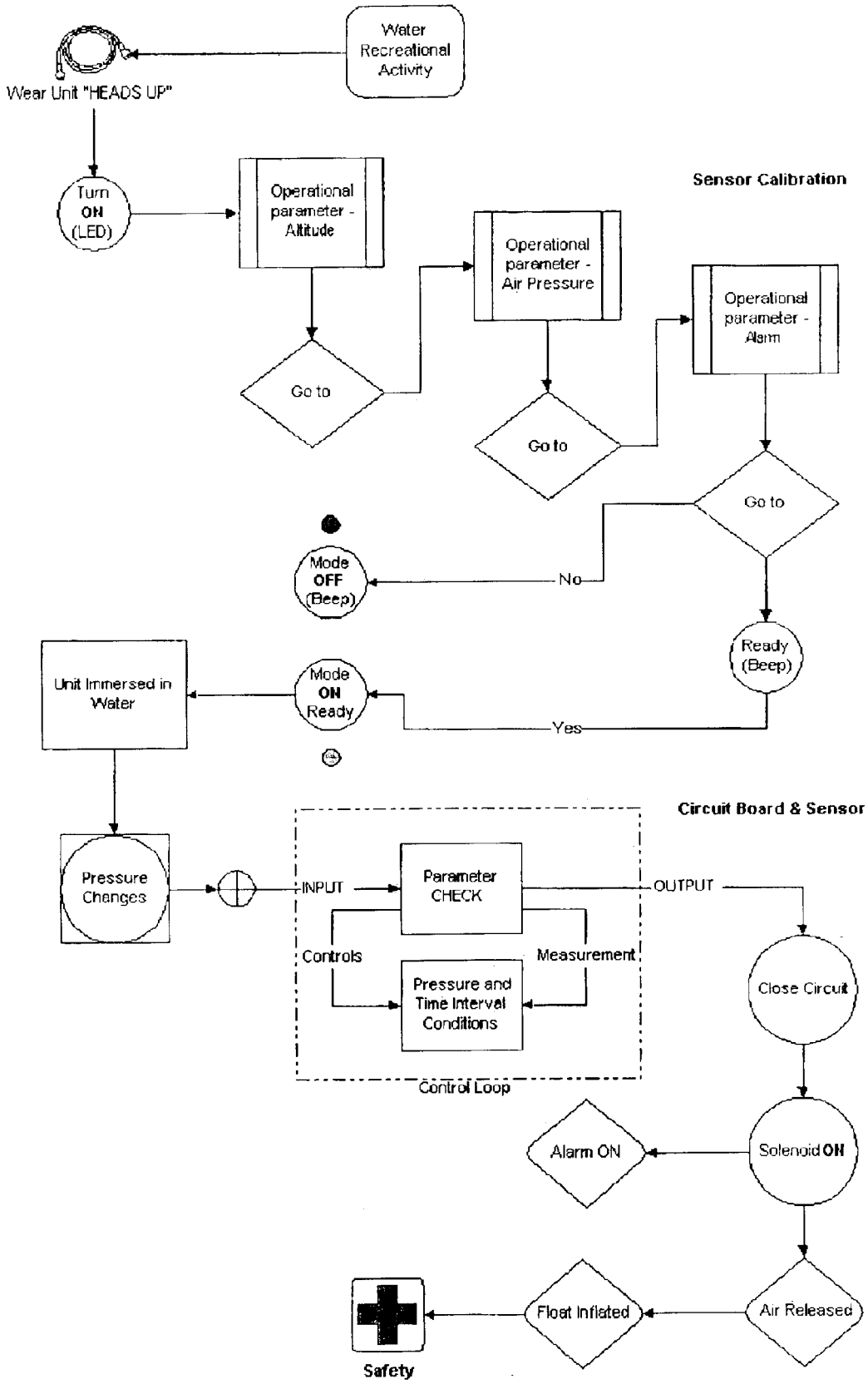
FIGURE VI

WEARABLE EMERGENCY FLOTATION DEVICE

FIELD OF THE INVENTION

This invention relates to emergency flotation devices, particularly to a wearable device in the form of a collar; and most particularly to a device suitable for wear by a pet or young child which may be worn during watersports, and which will not deploy until predetermined nominal safety parameters have been exceeded.

BACKGROUND OF THE INVENTION

The shocking and unfortunate reports of accidental drownings are constantly echoed in the media. A young child falls into a pool or a pond, having only been out of their caretakers sight for a moment, but tragically the child is found too late to be revived. Similarly a pet is left in its owners backyard, and while playing near the pool, the animal enters the water, is unable to get out, and becomes an unfortunate drowning victim.

Alternatively, a family is out for a day of fun at a pool, the beach, or while boating, and a pet or a child tires while playing in the water, and becomes a drowning victim.

Certainly, both parents and pet owners are astute enough to realize the dangers inherent in water sports, however the pleasures of playing in the water are often detracted from by the awkward and cumbersome forms of personal flotation device (PFD), which are available. While PFDs exist which are designed to be worn constantly, and which are less obtrusive, these devices are designed to be instantly deployable upon contact with the water. Due to this design, these devices suffer from the disadvantage that they are unsuitable for use in a situation where an animal or pet is permitted to play in the water, and the premature deployment of the device serves no purpose.

Thus, there exists a need for a comfortable and unobtrusive PFD which can be worn while playing in or about water, and which is deployable only when one or more nominal safety parameters have been exceeded.

DESCRIPTION OF THE PRIOR ART

U.S. Pat. No. 4,622,018, discloses an inflatable collar to be worn around the neck of a swimmer. The collar is buoyant in its uninflated state, and has an inflatable expandable accordion section positioned in front of the swimmer's face which the swimmer can grasp with his mouth to inflate. The inflated accordion section increases the buoyancy provided by the collar to keep the swimmer's head above water.

U.S. Pat. No. 5,421,760, discloses a self-inflatable mini-collar life preserver. The collar is formed from two symmetrical semicircular elements which are hingedly connected about the wearer's neck. Each semicircular element has a frame container filled with compressed air. Inflatable envelopes are attached to the exterior side of the frame container. When a control member is actuated, the compressed air is released through a valve into the inflatable envelope. The control member consists of a vacuum chamber which keeps a spring in a compressed position. The control member is actuated by breaking the vacuum to release the spring, which in turn presses the pin of the release valve. This patent discloses a means of automatic inflation in which a quantity of iodine lamella is disposed in a small channel leading to the chamber and seals the vacuum. If the wearer falls into the water, the water will soften or dissolve the iodine lamella and break the vacuum, thereby actuating the control member to inflate the life preserver.

U.S. Pat. No. 4,925,419, discloses a life preserver collar consisting of two symmetrical elements secured to one another to form a collar. Each element includes a container of compressed air and a plurality of containers having an expandable envelope disposed therein. The containers including the expandable envelopes cooperate to form a U-shaped neck protector. When actuated, the expandable envelopes are inflated and released from the container to provide support for a person in the water.

U.S. Pat. No. 5,746,633, discloses an inflatable personal floatation device which automatically inflates upon immersion in water The device is adapted to be positioned about the shoulders or neck of the user, and includes front and rear float portions, and a harness connected to the float which consists of a belt about the waist of the user which has shoulder straps attached to the float portions. A $CO_2$ cartridge disposed in the device inflates the float portions. The automatic inflator device is activated by an inflator pellet of a material which reacts with water to produce $CO_2$. If the flotation device falls into the water, the inflator pellet will dissolve in approximately 2 to 5 seconds upon contacting the water. The inflator pellet reacts with the water to produce $CO_2$ which inflates a tubular member which in turn causes gas to be dispelled from the $CO_2$ cartridge.

U.S. Pat. No. 5,692,933 disclose a low profile flotation collar intended for use by aircraft and shipboard personnel in an emergency that leaves the personnel in the water. The collar has a fabric shell housing two automatically inflatable, independent, and symmetric flotation cells, two oral inflators and mechanical inflator mounted on the fabric shell, and a face shield mounted in the fabric shell. This patent teaches the use of automatic saltwater sensing actuators to provide protection when an individual is unable to manually activate the device. The water sensor actuators are small electronic devices that are in the $CO_2$ inflation cylinder. When salt water enters the device, a sensor within causes a circuit to be closed, activating a mechanism used to pierce the $CO_2$ cylinder.

U.S. Pat. No. 5,813,891, discloses a life saving aid in the form of an elongate inflatable tube having an automatic inflation device which releases $CO_2$ when the tube is immersed in water. The tube has VELCRO™ fastening material at either end to allow the tube to be secured around the body of a person. Automatic inflation is accomplished by using a water soluble tablet within a trigger mechanism which dissolves on immersion in water and actuates the trigger mechanism.

The references illustrated in the prior art depict a variety of inflatable flotation devices, some of which are designed to be collars, however they fail to disclose a flotation aid which is compact in size, possesses an economy of form, and an absence of protruding exterior parts. Most importantly, the prior art devices each utilize automatic inflation means which must initiate deployment upon contact with water. These prior art devices, which are primarily designed to be life-saving devices for use in a man overboard type of rescue situation, are not suitable for use while a child or pet is engaged in recreational watersports or other situations where the wearer would necessarily contact the water. Thus, if a flotation collar could be provided which permits engagement in watersports, but automatically inflates only after a prolonged period of submersion, or alternatively, only at a specific water depth, a longfelt need would be satisfied.

SUMMARY OF THE INVENTION

The present invention provides a unique small flotation device, which will activate automatically when changes in pressure, e.g. water depth, time of submersion, or a combination thereof exceed predetermined nominal parameters. As the device senses the change in pressure or time of prolonged submersion, the internal triggering mechanism punctures a hole permitting the compressed gas reservoir contained therein to be released, thereby inflating the device's inner flotation member. The present invention is suitable for use during any activity requiring wearer safety. Such activities may include, but are not limited to, activities around bodies of water such as pools, lakes, rivers, canals and oceans.

Accordingly, it is an objective of the instant invention to provide a small and unobtrusive personal flotation device which may be worn during watersports, but which will not deploy until predetermined nominal safety parameters have been exceeded.

It is a further objective of the instant invention to provide a personal flotation device which is self-deployable upon exceeding said nominal safety parameters.

It is yet another objective of the instant invention to teach a device which is capable of self-calibration upon exposure to alternative elevations.

It is a still further objective of the invention to provide a device which both determines and confirms its operational readiness.

It is yet an additional objective of the instant invention to provide a PFD which automatically signals, e.g. via a light and/or sound creating device, that it has deployed.

These and other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE FIGURES

FIG. 1 illustrates a pictorial view of a flotation collar;

FIG. 2 illustrates a cut-away view of the main controller structure;

FIG. 3 is a cut-away view of the main controller detailing a preferred valve construction;

FIG. 4 is a cut-away view of the cooperation between the integral tube and float sections of the device;

FIG. 5 is a perspective view showing a deployed float section;

FIG. 6 is a block diagram which outlines the logistical scheme of operation of the flotation device.

DETAILED DESCRIPTION OF THE INVENTION

The instantly disclosed flotation collar includes a relatively rigid structure, or body, which supports or encloses all the components that make the device operational as well as a source of pressurized gas useful in deployment. In the past, flotation aids were relatively large and intended for the use of large $CO_2$ cartridges as sources of compressed gas. The instant flotation aid incorporates a compressed gas storage vessel integral therein, thereby permitting a device having a compact size and economy of form.

The device is activated prior to being placed on the individual, thereby assuring that upon submersion during conditions which exceed predetermined safety parameters, e.g. greater than a particular depth or for greater than a particular time interval, the device will automatically deploy, thus providing sufficient buoyancy for the wearer's head to be lifted from the water. Additionally, the sensor may include an ability to sense motion, thereby providing an additional parameter for system activation. Furthermore, an ability to pre-set or re-calibrate the system is provided to insure proper functioning at a particular altitude.

The personal flotation aid may further include a compact, but sufficiently loud sound producing means, e.g. a speaker, whistle, horn or the like, which initiates an audio alert, that can be activated as the PDF deploys. Operative power is supplied by a device powering means, e.g. a replaceable battery, e.g. a watch size battery, sufficient for long lasting operation.

The operable condition of the unit can be confirmed by appropriate means, e.g. by a light, such as a light emitting diode (LED) indicator or similar visual indicator in communication with the unit's circuit board or with one or more separate transducers or the like. Alternatively, the indicator could be a colored strip, e.g. a metallic strip, in e.g. green and red, that can indicate operability of the system. When in operative engagement or communication with a pressure source within the device, thereby registering the presence of nominal operating pressures sufficient for deployment, operability of the device is confirmed.

The pressure sensor which causes the unit to deploy is both small and reliable and possesses sufficient sensitivity to function under small pressure changes or gradients, and shall also be able to sense height to pressure changes and self-calibrate to properly operate at different elevations. An illustrative, albeit non-limiting example of such a sensor is available from Silicon Microstructures, Inc., Milpitas, Calif., which manufactures a pressure sensor which may be interfaced with a circuit board or controller so as to enable and activate the device. Suitable circuit boards may be obtained from various suppliers, for example E-Teknet, located at 1930 S. Alma School Road, Suite B114 Mesa, Az. 85210, which manufactures a flexible printed circuit board, which is single-sided and formed from a composite material, having a high degree of flexibility, is able to resist high and low temperature, is able to be folded without influence on signal transmission function, able to prevent electromagnetic interference (E.M.I.)and withstand changes in pressure and chemical environment, thus enabling it to be useful in reducing development time while increasing service life and the size of applicable product.

The sensor operates in accordance with variations of depth (pressure) as a function of time (seconds). Thus, as the unit passes certain depths, the unit will simultaneously calculate parameters of both constant and incremental pressure as functions of time. Thus, the unit may be wet or submerged repeatedly, but still will not be caused to deploy, unless certain pre-determined depth functions are exceeded past a pre-determined time function, alternatively motion sensors may be set to deploy the unit after a certain number of successive submersions within a particular time period, which would be indicative of a panic situation where the wearer requires a buoyancy aid.

Inclusion of a calibration function permits the pressure sensor to self-calibrate in order to account for changes in elevation or operational conditions, so as to insure proper operational deployment.

Deployment is via a mechanical actuator, which, in the preferred embodiment is illustrated as a single motion device, normally designed for, but not limited to, one time usage. The actuator must be capable of puncturing a closed pressurized gas container to initiate filling of the personal flotation device.

In a preferred embodiment, the device includes a flexible, external, essentially tubular structure, which protects and encloses the operative components and inflatable portion of the device. Illustrative, but non-limiting examples of the type of construction contemplated include a flexible tubing designed to enclose the inflatable body of the flotation device therein or be formed integral therewith. The inflatable body can be made from fabric, plastic or the like materials, provided that such materials provide for easy packaging while deflated, sufficient flexibility and both reasonable and reliable volumetric expansion upon inflation, especially after prolonged periods in a deflated state.

The compressed gas reservoir, which is designed for external loading, may be of a customized design, compatible with the volumetric area of the design intent. It is contemplated that a plurality of models might exist, depending upon the application as well as the type/size of pet/child using the device. In a preferred embodiment, the use of a micro $CO_2$ cartridge or self-contained compressed air cartridge will be included within the device.

Now referring to FIG. 1, the collar device is composed of three float sections, (F1, F2, and F3), a tube body (T), and a main controller (X). In a preferred embodiment, the three float sections may be inter-connected to one another. The tube body, (T), functions as a case or storage compartment for the flotation sections. However, the three flotation sections are attached to, or formed integral with the tube itself, thereby preventing the tube from detaching from the flotation sections, as they are deployed. The collar controller also contains the units gas reservoir, which is in fluid connection with the tube body.

As shown in FIG. 2, the main controller structure X is essentially rigidly constructed and provides a sealed compartment for containment of the pressurized gas and the various sensing and actuating components as more fully described herein. Within the controller there are ribs 10 which function to locate all of the components inside the unit X, provide rigidity and function as gas passage or flow channels. The ribs 10 are positioned in such a way as to allow the gas to flow (see arrows 16) uniformly into each of the adjacent floats (not shown). This is done as a safety feature to ensure independent-and reliable inflation of each of the three float sections. For gas to flow and inflate the float sections, an object 12 needs to penetrate the rubbery one-way valve 14. In a preferred embodiment, the object shall have a passage 18 situated, e.g. in the middle, to allow the gas to flow into the floats as the object 12 penetrates the one-way valve 14. The driven mechanism used to move the penetrating object will be a solenoid 20 or a similar type device. This device needs to perform a forward motion, needs to be small in size, fast and reliable. A spring 22 is used to keep both the driven mechanism and the penetrating object in place. Suitable solenoids are available from MAGNET-SCHULTZ OF AMERICA, INC., Westmont, Ill. and Tur-Bo Jet Products Co., Inc., Rosemead, Calif. 91770.

As set forth in FIG. 3, on the top area of the controller (X) a one-way valve V is located. This valve will be used to charge the unit once all the components are sealed inside. The one-way valve shall have some type of an indicator functionality either integral or in combination therewith, which shows that the unit is operational and/or is charged with sufficient gas pressure to operate. An On/Off button O, an LED (for indicating on/off, not shown) and a battery B will desirably be placed within the unit. This feature will allow the user to see whether the unit is on or off, as well as making it relatively easy to remove/replace the battery, if needed, thereby ensuring reliable unit operation. The On/Off button may have an additional function other than to enable the unit. Every time the unit is turned on, the device will self-calibrate, defining its surrounding pressure and working parameters.

In accordance with FIG. 4, the tube sectional split area is illustrated, showing the float (F) within the tube (T) as the float itself folds inside the tube. The tube has a split area that will allow the flotation device to deploy when gas pressure rushes inside. The tube shall be flexible and durable and also shall be able to be stretched to some extent permitting the same to be worn.

Now referring to FIG. 5, in a preferred embodiment, the tube (T) and float (F) are depicted as an integrally constructed unit. In this embodiment the tube (T) is simply constructed of a thicker plastic, which will contain therein the folded flotation section (F) which is formed of a thinner plastic or like material. When the flotation device depicted in this embodiment is deployed it shall look, in cross-section as the cross-sectional area shown.

FIG. 6 is a block diagram wherein a preferred embodiment of operation is outlined. Upon being turned on by activation of a device activation means (e.g. an on/off switch), the unit self calibrates to correct for altitude changes, the pressure sensing means (pressure sensor) communicates with the controller (circuit board) and ascertains that sufficient gas pressure is available for the system to be deemed operational, a visual LED or the like confirms operational status. Upon being submerged past the nominal safety parameters chosen, in this case predetermined pressure and time of submersion parameters (however motion per se may also be a nominal safety parameter), mechanical actuation takes place puncturing the gas reservoir and permitting deployment of the flotation sections, wherein increased buoyancy is obtained lifting the wearer's head from the water. Simultaneously, sound and/or visual alert devices may be activated.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A personal flotation device for providing passive protection while in water comprising:

a containment vessel including therein a device activation means in communication with a controller means and device powering means, said controller means communicatively linked to pressure sensing means, said pressure sensing means being operatively linked to at least one mechanical actuator means, said mechanical actuator means being constructed and arranged to cooperate with a valve structure constructed and arranged for release of pressurized gas from said vessel; and at least one inflatable body in fluid communication with said valve structure for receipt of said pressurized gas;

said pressure sensing means being constructed and arranged for cooperation with said controller means wherein release of said pressurized gas is prevented until nominal safety parameters including a combination of specific depth of submersion and specific time of submersion have simultaneously been exceeded;

said nominal safety parameters further include sensing of a specific type of motion;

whereby said device provides passive flotation safety to a wearer while in the water.

2. The device of claim 1 further including means for emitting an audible signal.

3. The device of claim 1, further including means for emitting a visual signal.

4. The device of claim 1 wherein said controller is a circuit board.

5. The device of claim 1 wherein said mechanical actuator means is a solenoid.

6. The device of claim 1 wherein said device powering means is a battery.

* * * * *